United States Patent [19]

Ivanov et al.

[11] Patent Number: 4,476,797

[45] Date of Patent: Oct. 16, 1984

[54] APPARATUS FOR ASSEMBLING A SHIP HULL MODULE

[76] Inventors: Jury P. Ivanov, Grazh-dansky prospekt, 92/2, kv. 1; Anatoly B. Averbukh, ulitsa Nalichnaya, 3/21, kv. 67; Evgeny A. Evstafiev, ulitsa Karpinskogo, 31/1, kv. 139; Alexandr E. Tarasov, Tallinskaya ulitsa, 6-a, kv. 23, all of Leningrad, U.S.S.R.

[21] Appl. No.: 346,055

[22] PCT Filed: May 29, 1981

[86] PCT No.: PCT/SU81/00050

§ 371 Date: Jan. 22, 1982

§ 102(e) Date: Jan. 22, 1982

[87] PCT Pub. No.: WO81/03474

PCT Pub. Date: Dec. 10, 1981

[30] Foreign Application Priority Data

Jun. 4, 1980 [SU] U.S.S.R. ..... 2926009
Jun. 4, 1980 [SU] U.S.S.R. ..... 2926011

[51] Int. Cl.[3] ..... B63B 3/00; B63B 9/00

[52] U.S. Cl. ..... 114/65 R; 114/77 R; 414/779

[58] Field of Search ..... 114/65 R, 77 R; 414/10.11, 681, 779, 783; 228/47, 44.1; 254/106, 124; 29/429, 785

[56] References Cited

U.S. PATENT DOCUMENTS

| | | | |
|---|---|---|---|
| 1,668,300 | 5/1928 | Aiken | 414/779 |
| 3,695,459 | 10/1972 | Raes | 414/779 |
| 3,698,344 | 10/1972 | Maeda | 114/77 R |
| 4,077,106 | 3/1978 | Lichtenstein et al. | 29/785 |

FOREIGN PATENT DOCUMENTS

| | | | |
|---|---|---|---|
| 2101359 | 3/1972 | France | 114/65 R |
| 51-43279 | 11/1976 | Japan | 114/65 R |
| 52-14275 | 3/1977 | Japan | 29/429 |

OTHER PUBLICATIONS

"Ship-Moving Equipment," Ettin & Chekletsov, Leningrad, Sudostroyeniye/Ship Building/Publishers (1970), p. 70 (FIG. 32).

"Cranes and Elevators in Industrial Enterprises," Ushakov & Brodsky, Moscow, Metallurgia Publishers (1974), p. 163, (FIG. 6.29).

"Integrated Mechanization of Hoisting and Conveying Operations in Shipyards," Plakhin, Leningrad, Sudostroyeniye/Ship Building/Publishers (1973, pp. 121 and 122), FIGS. 73.

"Handbook for General-Purpose Construction Engineering," Sdroyizdat Publishers (1959), p. 311.

*Primary Examiner*—Trygve M. Blix
*Assistant Examiner*—Rodney Corl
*Attorney, Agent, or Firm*—Lilling & Greenspan

[57] ABSTRACT

The invention relates to shipbuilding. A method for assembling a ship hull module comprising a transverse bulkhead section and two pairs of sections perpendicular thereto, consisting in that first the transverse bulkhead section is installed in a horizontal position, then the section of one of the pairs of sections perpendicular to the transverse bulkhead is installed in a vertical position and joined to the transverse bulkhead section. The assembled portion of the module is turned about the vertical axis, the section of the other pair is installed in a vertical position and joined to the already assembled portion of the module. The assembled portion of the module is again turned about the vertical axis, the remaining section of the first pair is installed in a vertical position and joined to the assembled portion of the module. Then the assembled portion of the module is turned once more about the vertical axis, the remaining section of the second pair is installed and joined to the assembled portion of the module to make up in such a way a ship hull module. An apparatus for effecting the method for assembling a ship hull module includes a bearing platform mounting a turnover platform fitted with a drive to turn it about the horizontal axis and with grippers to hold the sections of the module being assembled. An additional platform adapted to reciprocate in a vertical plane and to turn about the vertical axis of symmetry is disposed in close proximity to the bearing platform. The bearing platform is provided with movable bogies adapted to roll on to the additional platform.

2 Claims, 17 Drawing Figures

APPARATUS FOR ASSEMBLING A SHIP HULL MODULE

FIELD OF THE INVENTION

The invention relates to shipbuilding and more particularly to methods for assembling modules of a ship hull and apparatus for effecting same.

These modules are then used to assemble parallel middle bodies of hulls of ships intended to carry liquid, bulk and gaseous cargoes.

DESCRIPTION OF THE PRIOR ART

A module of a ship hull is a rigid structure comprising a transverse bulkhead section and two pairs of sections perpendicular thereto and installed at its ends.

Depending on the type of the perpendicular sections, the module being assembled may be a D-type module which includes a deck section and a bottom section—one pair, and a side section and a longitudinal bulkhead section—another pair;

a complete module which includes a deck section and a bottom section—one pair, and a starboard side section and a port side section—another pair; and a central module which includes a deck section and a bottom section—one pair, and two sections of longitudinal bulkheads—another pair.

At present there is known in the art a method of assembling a D-type module of a ship hull (cf. French Pat. No. 2,101,359, cl. B63b 3/00, 1972) according to which a module is assembled in the following sequence.

First a transverse bulkhead section is installed in a horizontal position on the supports with the help of a crane, whereupon a longitudinal bulkhead section and a side section are in the same way installed in a vertical position and joined to the transverse bulkhead section. Then a bottom section and a deck section are installed in a vertical position and joined to the already assembled section to make up a D-type module.

The sections are joined together with the use of any known technique providing a permanent connection, for example welding.

All the sections are installed in the predetermined positions with the help of cranes.

A disadvantage of such a method of assembly is that the assembly of a D-type module with the use of tranditional cranes is characterized by long duration of erection work and great amount of poorly mechanized adjustment work, which results in an increase in the time spent for assembling modules and in a decrease in labour productivity. For example, the installation of a section in the predetermined position requires several hours and is characterized by a great amount of manual operations performed when marking the section edges, Moreover, the adjustment of edges of the sections is performed either with the section positioned vertically which prevents mechanization of the work or requires additional operations to be performed, such as placing the sections to a horizontal position, cutting the edges and installing the sections again in a vertical position.

There is also known in the art an apparatus (cf. Japanese Pat. No. 51-43279, cl. B63b 9/06, 1976) for assembling blocks, for example of a double bottom of a ship hull. The block being assembled consists of two sections mounting the framing and joined together.

The apparatus disclosed in the above-indicated patent comprises two symmetrical bearing platforms mounting turnover platforms. Each turnover platform is fitted with a drive to turn it about the horizontal axis and with grippers to hold sections of the block being assembled. The axes of rotation of the turnover platforms are disposed at the adjacent ends thereof which ensures their turning towards each other.

Prior to assembling a block both turnover platforms are positioned horizontally. Then a section of the block to be assembled is placed on each turnover platform and secured by means of the grippers. The turnover platforms are rotated towards each other to bring the sections in proper registry, whereupon the sections are welded together to make up the block of a double bottom of a ship hull.

However, said apparatus cannot be used to assemble D-type or complete modules of a ship hull, comprising a transverse bulkhead and two pairs of sections perpendicular thereto and installed at the ends thereof. Moreover, the apparatus design is inefficient since one and the same operation, viz., turning of the sections from a horizontal to a vertical position, is carried out by two identical turnover platforms.

SUMMARY OF THE INVENTION

The present invention is essentially aimed at providing a method for assembling ship hull module and an apparatus for effecting the same which by virtue of changing the sequence of assembly operations and creating additional transfer and gripping means would enable an increase in the level of mechanization of the hull assembly work and a substantial decrease in the time required for the assembly.

This aim is attained by a method for assembling a ship hull module comprising a transverse bulkhead section and two pairs of sections perpendicular thereto, whereby in the module assembly location the transverse bulkhead section is installed in a horizontal position. Then the sections of both the pairs of sections perpendicular to the transverse bulkhead are installed in a vertical position and joined to each other and to the transverse bulkhead section. According to the invention upon installation of the transverse bulkhead section in a horizontal position, and a section of one of the pairs of sections perpendicular to the transverse bulkhead is installed in a vertical position in the assembly location and joined to the transverse bulkhead section. The assembled portion of the module is then turned about the vertical axis, a section of the other pair is installed in a vertical position and joined to the already assembled portion of the module. Then the whole assembled portion of the module is again turned about the vertical axis, and the remaining section of the first pair of sections perpendicular to the transverse bulkhead is installed in a vertical position and joined to the assembled portion of the module. The already assembled portion of the module is then turned once more about the vertical axis, and the remaining section of the second pair is installed and joined to the assembled portion of the module, thereby making up the ship hull module.

This aim is also attained by an apparatus for carrying the method of assembling a D-type module into effect, comprising a hearing platform mounting a turnover platform fitted with a drive to turn it about the horizontal axis and grippers to hold the sections of the module being assembled. According to the invention an additional platform is installed in close proximity to the bearing platform and adapted to reciprocate in a vertical plane and to rotate about the vertical axis of symmetry. The bearing platform has movable bogies adapted to roll on to the additional platform. The grippers of the turnover platform are adapted to move in three mutually perpendicular directions due to which the gripped section can be displaced along the longitudinal and transverse axes of the turnover platform, as well as can be lifted and lowered with respect to the bearing surface of the turnover platform.

Preferably, the turnover platform is provided with shaped supporting segments mounted at a right angle to the bearing surface thereof on the side facing the additional platform, and the drive to turn the turnover platform is made in the form of hydraulic cylinders horizontally fixed on the bearing platform with their piston rods provided with supporting rollers interacting with the shaped segments of the turnover platform in the process of turning thereof.

The method and apparatus according to the invention make it possible to fully mechanize the process of assembling D-type or complete modules of a ship hull with the use of a universal hull construction work unit, as well as to mechanize the process of exact orientation of the sections in the most suitable horizontal position with the subsequent turning thereof to the predetermined position and thus to increase the labour productivity in fabrication of ship hulls and to curtail the time normally required for the shipbuilding.

BRIEF DESCRIPTION OF THE DRAWINGS

The invention will be further described in connection with an embodiment thereof, with reference being made to the accompanying drawings, wherein.

DETAILED DESCRIPTION OF THE INVENTION

The claimed method for assembling a ship hull module is considered hereinbelow as applied to the assembly of a D-type module of a hull of a tanker.

Figure 1:
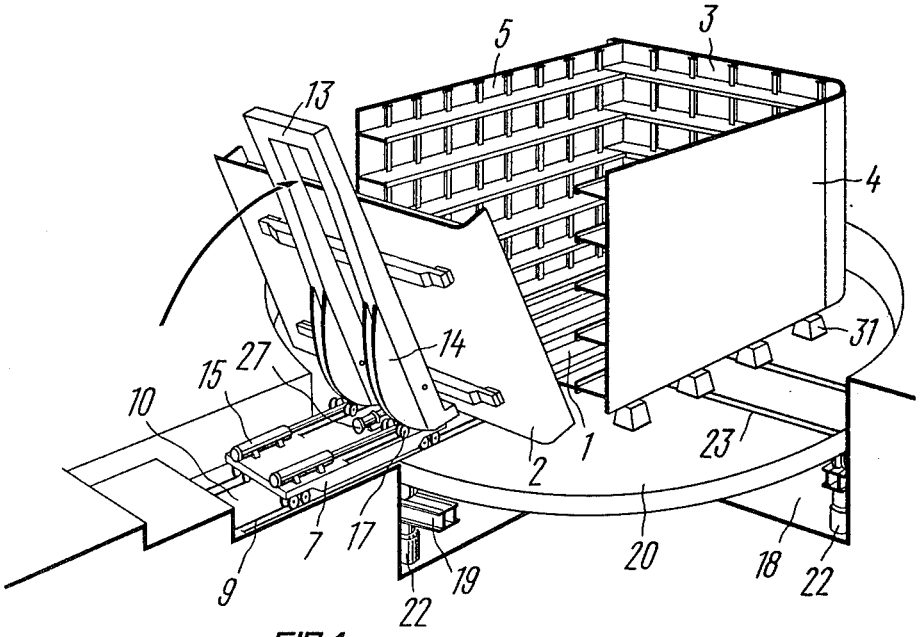
FIG. 1 is an axonometric view diagrammatically representing the installation of a deck section of a D-type module being assembled, according to the invention.

A D-type module (FIG. 1) being assembled comprises a transverse bulkhead section 1 and two pairs of sections perpendicular thereto and installed at its ends, viz., one pair including a deck section 2 and a bottom section 3 and another pair including a side section 4 and a longitudinal bulkhead section 5. In some cases the transverse bulkhead section 1 may be absent, but taken here, by way of example, is a D-type module of a tanker hull, comprising all the sections 1 to 5.

The claimed method for assembling a ship hull module consists in the following.

Figure 2:
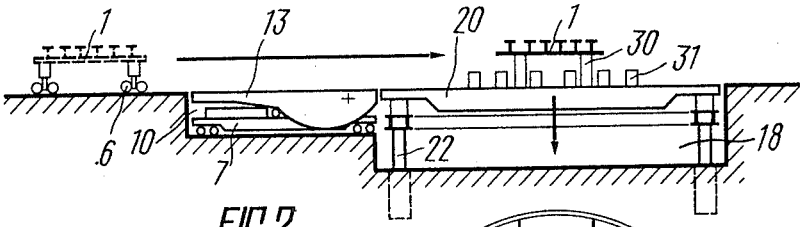
FIGS. 2 to 11 illustrate the sequence of operations when assembling a D-type module of a ship hull, according to the invention.
Figure 3:
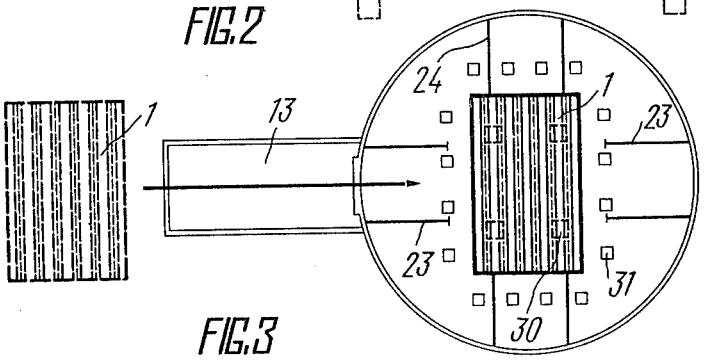
Figure 5:
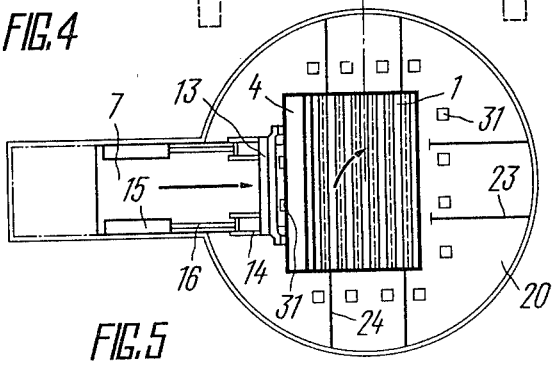
Figure 6:
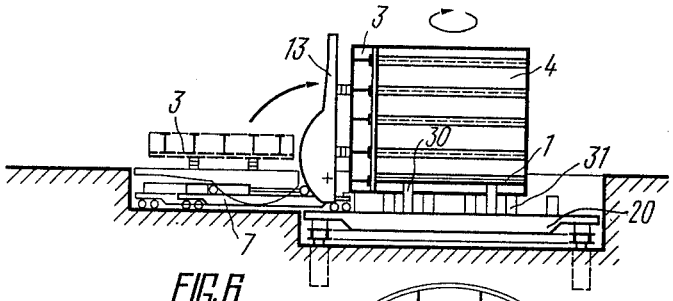
Figure 7:
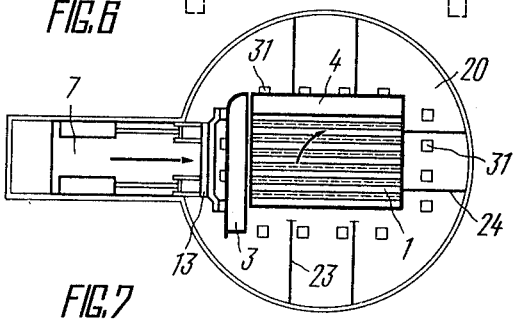

First the transverse bulkhead section 1 (FIGS. 2 and 3) is delivered to the assembly location by means of a ground transport, such as hauling carriages 6, or any other facilities, and installed in a horizontal position. Then any section of a pair of sections perpendicular to the transverse bulkhead 1, for example the side section 4 (FIGS. 4 and 5) is delivered to the assembled location. The section to be first supplied to the assembly location is selected depending on a specific procedure of assembling a D-type module. After the side section 4 has been delivered to the assembly location it is installed in a vertical position and welded to the transverse bulkhead section 1. To provide a required geometrical inalterability of the assembled portion of the module, the sections 1 and 4 are linked by manufacturing rods (not shown in the drawing) which are dismantled later on. After that the assembled portion of the module is rotated, for example clockwise, about the vertical axis, a section of the other pair, for example the bottom section 3 (FIGS. 6 and 7) is supplied to the assembly location, installed in a vertical position and welded to the already assembled portion of the module.

Figure 8:
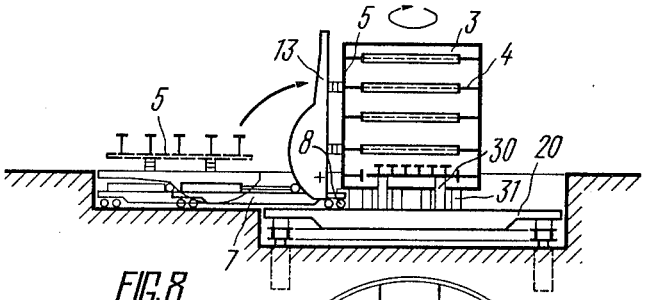
Figure 9:
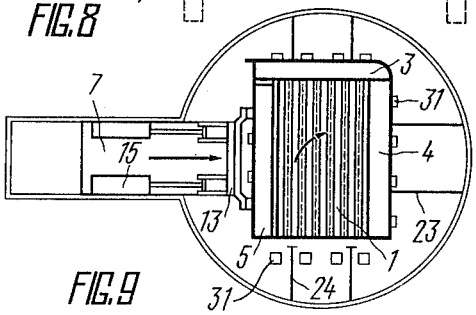

The welding of the bottom section 3 to the sections 1 and 4 completed, the assembled portion of the module is rotated clockwise, the second section of the first pair, viz., the longitudinal bulkhead section 5 (FIGS. 8 and 9) is delivered to the assembly location to be installed in a vertical position and welded to the assembled portion of the module.

Figure 10:
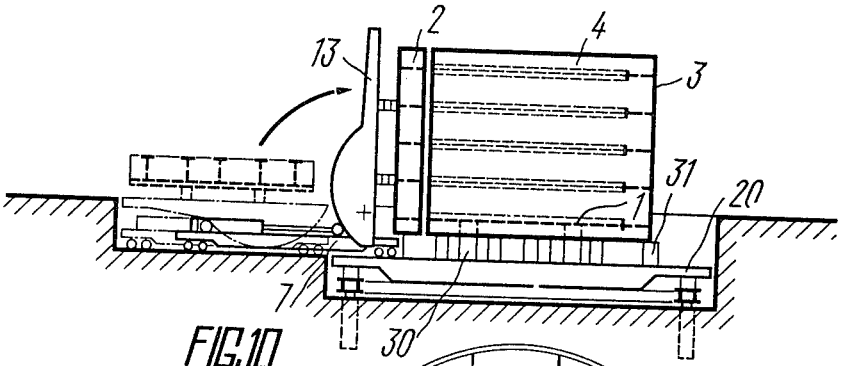
Figure 11:
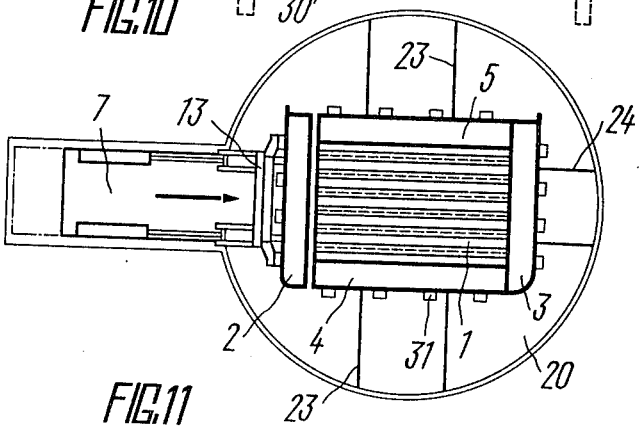

Then the assembled portion of the module, which comprises the section 1, 4, 3 and 5, is again rotated clockwise, the remaining section of the second pair viz., the deck section 2 (FIGS. 10 and 11), is supplied to the assembly location, installed there in a vertical position and welded to the assembled portion of the module, thereby making up the D-type module of a ship hull.

Figure 12:
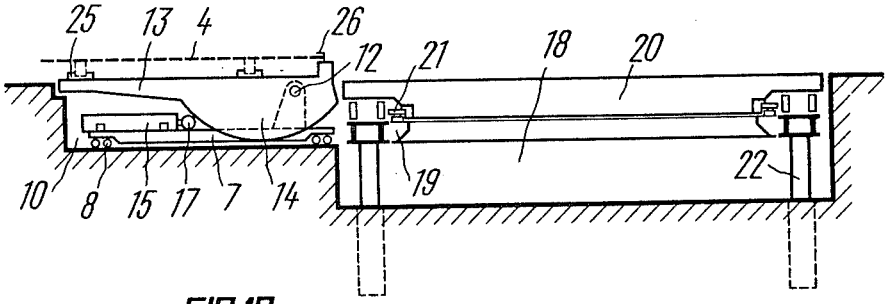
FIG. 12 is a longitudinal sectional view of an apparatus for carrying into effect a method for assembling a ship hull module with a turnover platform in a horizontal position, according to the invention.
Figure 13:
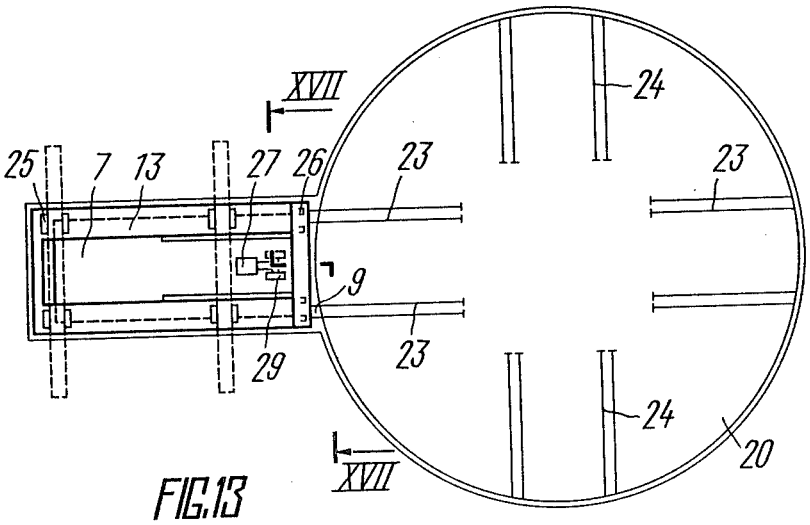
FIG. 13 is a plan view of an apparatus according to the invention.

An apparatus for assembling modules of a ship hull comprises a bearing platform 7 (FIG. 12) mounted on bogies 8 travelling along rail tracks 9 (FIGS. 13 and 17) laid on the bottom of an areaway 10 (FIG. 12) of the assembly location.

Figure 17:
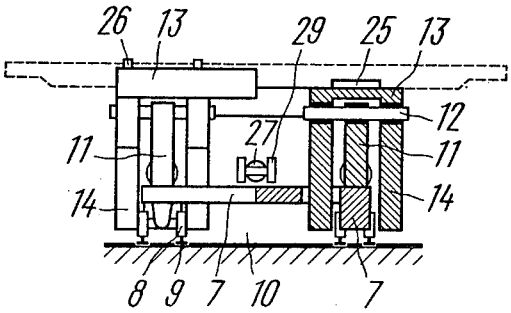
FIG. 17 is a sectional view taken on line XVII—XVII of FIG. 13, according to the invention.

The bogies 8 are provided with a drive (not shown in the drawing) to cause them to move along the rail tracks 9. At an end of the bearing platform 7 (FIG. 15) there are attached supports 11 in which an end of a turnover platform 13 is hingedly secured with the help of horizontal axles 12 (FIG. 17). At the point of connection to the supports 11, the turnover platform 13 is provided with shaped supporting segments 14 (FIG. 12) disposed at a right angle to the bearing surface thereof. To turn the turnover platform 13 around the axles 12, the use is made of hydraulic cylinders 15 (FIG. 15). A barrel of each hydraulic cylinder 15 is horizontally fixed on the bearing platform 7 (FIG. 14) and a piston rod 16 thereof is provided with supporting rollers 17 interacting with the shaped supporting segments 14 and the bearing platform 7 in the process of turning the turnover platform 13.

An additional platform 20 (FIG. 12) is installed on a supporting ring 19 in close proximity to the bearing platform 7 on the side of the supports 11 in an areaway 18 of the assembly site. Rotation of the supporting ring 19 together with the platform 20 about the vertical axis of symmetry is performed with the help of a slewing gear 21, for example a tooth-type slewing gear. The ring 19 and platform 20 are lifted and lowered by means of a lifting mechanism, such as hydraulic cylinders 22 located in pits of the areaway 18 along the perimeter of the supporting ring 19. Mutually perpendicular rail tracks 23 and 24 (FIG. 13) are mounted on the platform 20. The rail tracks 9, 23 and 24 are of the same gauge.

The depth of the areaway 10 (FIG. 12) should be such as to ensure alignment of the bearing surface of the turnover platform 13 in a horizontal position with the surface of the assembly floor, whereas the depth of the areaway 18 should be such as to ensure alignment with regard to the height of the rail tracks 9 on the bottom of the areaway 10 with the rail tracks 23 and 24 on the platform 20 with the latter being in the lowermost position. The lift of the platform 20 should be such as to ensure alignment of its bearing surface in the uppermost position with the surface of the assembly floor.

Secured to the turnover platform 13 are grippers 25 and hold-down grippers 26 (FIG. 12) intended to hold the sections 2 to 5 in the process of their installation. The grippers 25 and 26 are adapted to move in three mutually perpendicular directions due to which a gripped section, for example the section 4, can be displaced along the longitudinal and transverse axes of the turnover platform 13, as well as can be lifted and lowered with respect to the bearing surface of the turnover platform 13.

Figure 16:
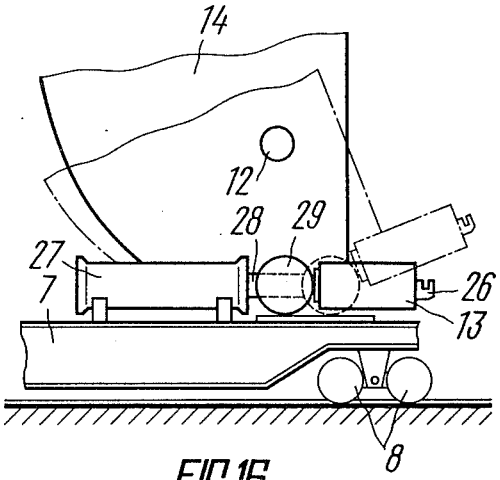
FIG. 16 is a sectional view taken on line XVI—XVI of FIG. 15.

The turnover platform 13 while moving to the predetermined position is decelerated and fixed in the predetermined position with the help of, for example, a hydraulic cylinder 27 (FIG. 16). The barrel of the hydraulic cylinder 27 is rigidly secured on the bearing platform 7 and its piston rod 28 is provided with supporting rollers 29 against which the turnover platform 13 rests when being decelerated and fixed in the predetermined position intended for the installation of the section.

Considered below, by way of example, the assembly of said D-type module of a tanker with the use of the apparatus of the invention.

Prior to assembling a module, the turnover platform 13 is set in a horizontal position (FIG. 12) and the additional platform 20 is positioned so that its bearing surface coincides with the surface of the assembly floor. Then supports 30 (FIGS. 2 and 3) to receive the transverse bulkhead section 1 and supports 31 to receive the sections 2 to 5 perpendicular to the transverse bulkhead 1 are installed on the platform 20.

Said operations completed, with the help of hauling carriages 6 or any other means the transverse bulkhead section 1 is delivered to the additional platform 20 and placed on the supports 30 (FIG. 3) so that the edge of the section 1, to which will be joined the next section, say the side section 4, would be perpendicular to the rails of one track, say track 23. This done, the side section 4 (FIGS. 4 and 12) is supplied to the turnover platform 13 positioned horizontally and fixed in the grippers 25 and hold-down grippers 26. Then with the help of the grippers 25 and 26 the section is given an attitude necessary for installing in the designated plane after the turnover platform 13 is turned.

Figure 4:
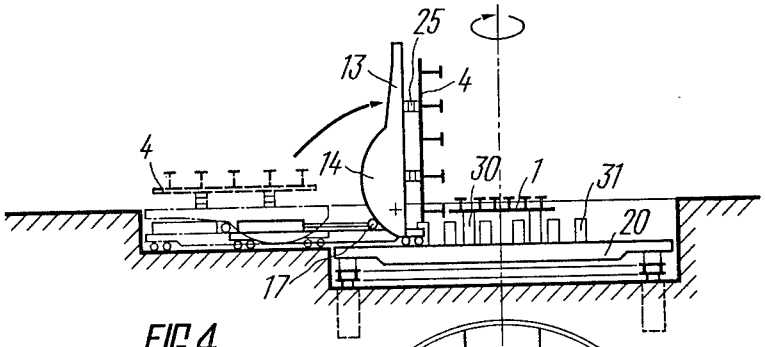
Figure 14:
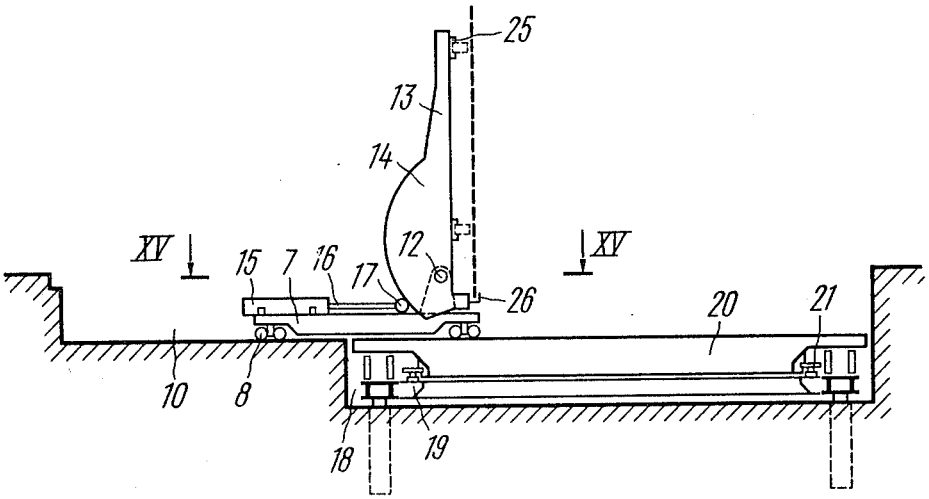
FIG. 14 is a longitudinal sectional view of an apparatus with a turnover platform in a vertical position.
Figure 15:
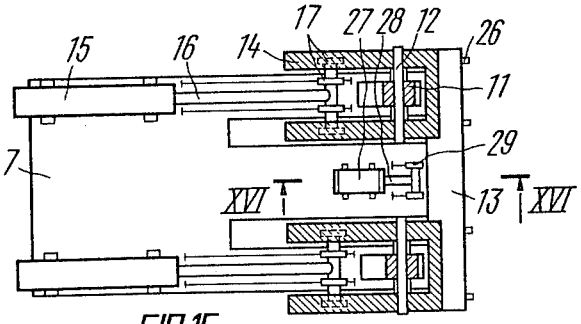
FIG. 15 is a sectional view taken on line XV—XV of FIG. 14, according to the invention.

With the use of the hydraulic cylinders 22 and the slewing gear 21, the additional platform 20 (FIGS. 5 and 13) is lowered and rotated, if necessary, to the position in which the rail tracks 9 and 23 become aligned, whereupon with the help of the bogies 8 actuated by the drive the bearing platform 7 together with the turnover platform 13 rides along the tracks 9 and 23 on to the platform 20 (FIG. 14). The distance of longitudinal displacement of the bearing platform 7 depends on the overall dimensions of the module being assembled. After that the hydraulic cylinders 15 are actuated. The piston rods 16 of the hydraulic cylinders 15 begin to extend, their supporting rollers 17 roll over the shaped supporting segments 14 of the turnover platform 13 and guides on the upper surface of the bearing platform 7 causing the turnover platform 13 to turn in the supports 11 about the horizontal axles 12; the piston rod 28 (FIG. 16) of the hydraulic cylinder 27 remains in the extended position. The platform 13 carrying the section 4 is turned until the section 4 assumes the predetermined position necessary for assembly (FIG. 4). In so doing, when the center of gravity of the platform 13 carrying the section 4 appears to be in the plane of the axis of rotation of the platform 13, the supporting rollers 17 cease to rest against the segments 14 and the platform 13 together with the section 4 starts to rotate around the axles 12 under the action of an overturning moment. At this time the extended supporting rollers 29 (FIG. 16) of the hydraulic cylinder 27 thrust against the platform 13 and take up the load of the rotating platform 13 and the section 4. The hydraulic cylinder 27 decelerates the platform 13 smoothly displacing the piston rod 28. After the section 4 has been set in the predetermined position necessary for assembly, the hydraulic cylinder 27 is cut out to fix the platform 13 in position, the sections 1 and 4 are brought in proper registry and welded. Inconsiderable displacements of the sections 1 and 4 in the process of bringing them in proper registry are effected with the help of the grippers 25 (FIGS. 4 and 14), the hold-down grippers 26 and supports 30 and 31. Upon being welded the sections 1 and 4 are linked with the manufacturing rods (not shown in the drawing), which is necessary to prevent the assembled portion of the module from changing the geometric shape thereof in the process of the following assembly.

The joining of the sections 1 and 4 over, the section 4 is released from the grippers 25 and the hold-down grippers 26 and, as a result, the assembled portion of the module rests on the supports 30 (FIG. 4) positioned under the transverse bulkhead section 1 and on the supports 31 positioned under the side section 4.

Then the hydraulic cylinder 27 is actuated as a result of which the piston rod 28 (FIG. 16) extends, the supporting rollers 29 thrust against the platform 13 and turn it through such an angle as to make the center of gravity of the platform 13 go out of the plane of the axis of rotation of the platform 13. The platform 13 starts rotating by gravity around the axles 12 while resting with the shaped segments 13 (FIG. 14) on the supporting rollers 17 which slide on the guides of the bearing platform 7. After the rollers 17 have returned to the initial position and, as a result, the platform 13 has assumed a horizontal position (FIG. 12) the drive moving the bogies 8 is started and the bearing platform 7 together with the turnover platform 13 is displaced along the rail tracks 23 and 9 of the platform 20 to the end of the areaway 10. This done, the use is made of the slewing gear 21 to rotate the platform 20 with the assembled portion of the module deposited on the supports 30 and 31 about the vertical axis of symmetry until the rail tracks 24 of the other direction and 9 (FIG. 7) coincide. In such a case the assembled portion of the module is turned so that the next free edge of the transverse bulkhead section 1 is positioned opposite to the line of feed of the bottom section 3.

After that the bottom section 3, the longitudinal bulkhead section 5 and, finally, the deck section 2 are supplied in succession to the assembly location, installed on the turnover platform 13 and, as described above, brought to the predetermined position to be joined to the assembled portion of the module. After each of the sections 3, 5 and 2 has been installed and welded to the assembled portion, the additional platform 20 together with the assembled portion of the module is turned about the vertical axis of symmetry.

The assembly of the module completed, the additional platform 20 with the D-type module deposited on the supports 30 and 31 is lifted with the help of the hydraulic cylinders 22 so as to align its upper surface with the surface of the assembly floor. Then the supports 30 and some part of the supports 31 carrying a pair of sections perpendicular to the transverse bulkhead 1, for example the sections 4 and 5, are removed, whereupon transport cars (not shown in the drawing) are introduced under said pair of sections, the module is taken from the supports 31 on to the transport cars and transferred from the platform 20.

The claimed method for assembling a ship hull module and the apparatus for effecting the same make it possible:

to assembly modules (D-type and complete) for ships of all classes intended to carry bulk, liquid and gaseous cargoes;

to fully mechanize the process of assembly of ship hull modules with the use of a universal apparatus, provided sections of a module are installed in the predetermined position necessary for assembly on the horizontal surface of the turnover platform;

to substantially increase the accuracy of installation of sections to the predetermined position and to reduce the time required for adjusting the edges of the sections; and to markedly increase the labour productivity in construction of ship hulls.

INDUSTRIAL APPLICABILITY

The claimed method for assembling a ship hull module and the apparatus for effecting the same are intended principally for use in assembling ships carrying liquid, bulk and gaseous cargoes.

We claim:

1. An apparatus for assembling a ship hull module, comprising a bearing platform mounting a turnover platform fitted with a drive to turn it about the horizontal axis and grippers to hold the sections of the module being assembled; an additional platform installed in close proximity to the bearing platform and to reciprocate in a vertical plane and to rotate about the vertical axis of symmetry; the bearing platform being provided with movable bogies to roll on to the additional platform, the grippers of the turnover platform moving in three mutually perpendicular directions, the gripped section being movable along the longitudinal and transverse axes of the turnover platform, and it can be lifted and lowered with respect to the bearing surface of the turnover platform.

2. An apparatus as claimed in claim 1, wherein the turnover platform is provided with shaped supporting segments mounted at a right angle to the bearing surface thereof on the side facing the additional platform, and the drive to turn the turnover platform is made in the form of hydraulic cylinders horizontally fixed on the bearing platform, piston rods of said cylinders being provided with supporting rollers interacting with the shaped segments of the turnover platform in the process of turning thereof.

* * * * *